United States Patent [19]

Elmer

[11] Patent Number: 4,480,699

[45] Date of Patent: Nov. 6, 1984

[54] COMPRESSED-AIR SCREWDRIVER WITH SHUTOFF BYPASS MEANS

[75] Inventor: Stefan Elmer, Oetisheim, Fed. Rep. of Germany

[73] Assignee: Firma Schmid & Wezel, Maulbronn, Fed. Rep. of Germany

[21] Appl. No.: 74,451

[22] Filed: Sep. 11, 1979

[30] Foreign Application Priority Data

Sep. 15, 1978 [DE] Fed. Rep. of Germany ..... 2840140

[51] Int. Cl.[3] ..... B25B 23/145

[52] U.S. Cl. ..... 173/12; 81/470

[58] Field of Search ..... 173/12; 81/470, 52.4 A

[56] References Cited

U.S. PATENT DOCUMENTS 3,195,704 7/1965 Linsker ..... 173/12 X
3,612,236 10/1971 Klinten ..... 81/52.4 A X
3,811,513 5/1974 Wezeh ..... 173/12
3,993,145 11/1976 Findeli ..... 173/12
4,006,785 2/1977 Roll et al. ..... 173/12
4,088,197 5/1978 Roll et al. ..... 173/12

FOREIGN PATENT DOCUMENTS 2617610 11/1976 Fed. Rep. of Germany ... 81/52.4 A

*Primary Examiner*—Robert R. Mackey
*Attorney, Agent, or Firm*—Edwin E. Greigg

[57] ABSTRACT

The invention relates to a compressed-air screwdriver including a tool spindle, displacable against the action of a spring; an automatic shutoff having a valve for the motor, which upon attaining a predetermined torque is turned off and a device whose actuation, after the automatic shutoff, permits the motor to be put back into operation so that a screw can be further tightened or loosened with increased torque.

7 Claims, 2 Drawing Figures

COMPRESSED-AIR SCREWDRIVER WITH SHUTOFF BYPASS MEANS

BACKGROUND OF THE INVENTION

A compressed-air screwdriver with automatic shutoff is known, for example, from the German Pat. No. 2,148,739. With this screwdriver, a jammed screw cannot be further tightened or loosened after the automatic shutoff turns off and, in this event, a different hand tool must be used in order to tighten or loosen such a screw. This wastes time and is overly complicated.

A compressed air screwdriver known as "S-Plus", by Robert Bosch GmbH as described in technical sheet number 109, is provided with a device actuatable by means of a special switch lever, with which device the motor can be put back into gear after being turned-off by the automatic shutoff, so that the screw can still be tightened or loosened with increased torque without requiring a change of tools. However, it is bothersome that, in such a case, a specific lever must be actuated.

OBJECT AND SUMMARY OF THE INVENTION

It is accordingly a principal object of the present invention to provide a new and novel compressed-air screwdriver which permits the tightening or loosening of a sluggish screw without the additional actuation of a lever and with increased torque.

In order to attain this object, the invention provides that the restarting of the motor, after being shut off upon attaining a predetermined torque, takes place automatically by means of a further inward displacement of the tool spindle.

Thus, no special lever needs to be actuated with the construction of the invention. Instead, the motor is automatically turned back on upon the exertion of a somewhat greater pressure on the tool, so that the screw is further rotated with increased torque, via a ratchet coupling contained in the automatic shutoff, by means of a rapid succession of thrusts with the tool. The magnitude of the increased torque is dependent on the structural design of the shifting coupling and of the automatic shutoff. In most cases, an increase in torque of approximately 20% is sufficient. The stiffness of a compression spring used in the automatic shutoff and the size and shape of the couplers and their opposing surfaces in the automatic shutoff have a substantial influence on the increase in torque.

The structure for attaining this object becomes particularly simple when the valve which controls motor operation is openable directly or indirectly by means of a further axial displacement of the tool spindle. In a compressed-air screwdriver having a valve rod cooperating with the valve and where the valve rod can be blocked and then released upon attaining the predetermined rpm via an actuation element, preferably in the form of a ball, the length of the valve rod and the possible displacement path of the tool spindle can advantageously be established in such a manner that the valve can be opened by the valve rod and then released by the actuation element, upon a further axial displacement of the tool spindle. In particularly simple manner, the valve rod can be directly displaceable by means of a contact surface on the bore spindle wherein the contact surface may be formed by the bottom of an axial bore in the tool spindle which guides the driver rod.

In order to assure a sufficient axial displacement path, the end of the tool spindle on the motor side may be housed in a driver portion of the gearing in an axially displaceable or drivable manner, which results in a short structure with simultaneous appropriate guidance for the tool spindle.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 2:
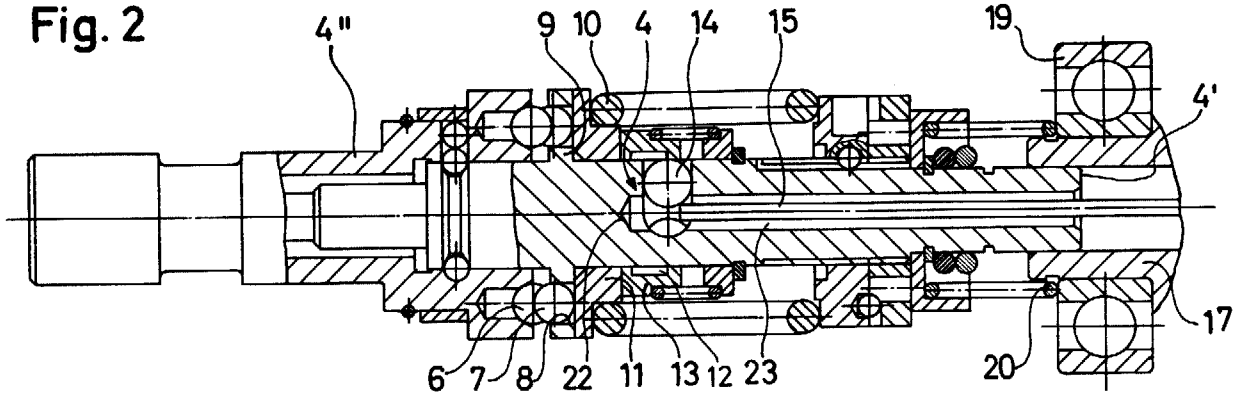
FIG. 2 is an enlargement of a section of FIG. 1.
Figure 1:
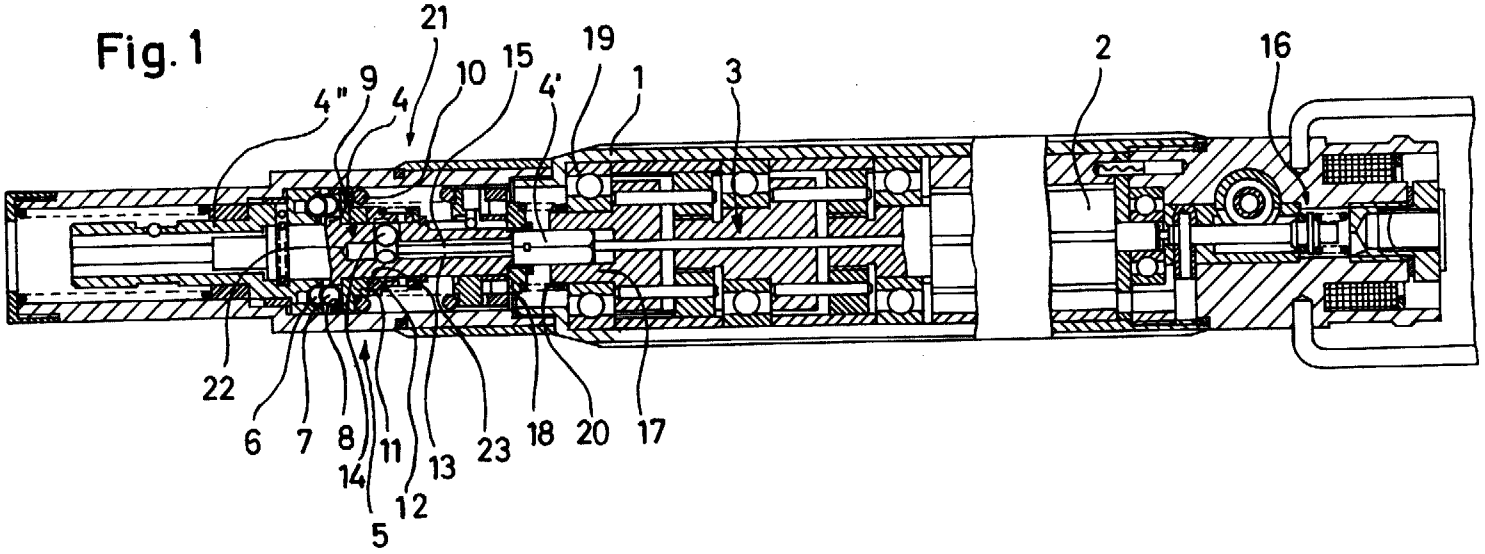
FIG. 1 is a longitudinal cross-sectional view through a preferred embodiment of the compression-air screwdriver of the invention.

Turning to the drawing, a motor 2 which can be driven with compressed air is supported in a housing 1 and is arranged to drive a tool spindle 4 via a gear 3, preferably a two-stage planetary gear. The tool spindle 4 is formed in two portions, with a portion drivable by the motor and indicated by reference numeral 4', being coupled via a shifting coupling 5, which limits the torque, with a portion 4'' arranged to include a tool.

In order to form the shifting coupling 5, recesses 6 are provided on the periphery of the portion 4'', into which couplers in the form of balls 7 move for engagement. The balls 7 are held in apertures S of a shoulder 9 on the drivable portion 4' and contact a plate 11 which is pressed against the shoulder 9 by a spring 10, the initial tension of which is adjustable. The plate 11 is connected with a ring 13 having an internal groove 12. An actuation element in the form of one or more balls 14, displaceable in a bore of the portion 4', is controllable by means of the ring 13. In one position of the ring 13, the ball or balls 14 can move partway into the groove 12 and thus release a valve rod 15. In the other position of the ring 13, axial movement of the valve rod 15 is blocked. The valve rod 15 penetrates the gear 3 and the motor 2 and cooperates, with its end, with the valve body of a valve 16, by means of which the air entry to the motor 2 is controlled. The delivery of compressed air is effected by a channel (not shown) in the manner described in U.S. Pat. No. 4,088,197 to Roll et al. The precise manner of air delivery is not important to the present invention and need not be discussed further.

The end of the portion 4' of the tool spindle 4 on the motor side is further guided in an axially displaceable or drivable manner in an appropriately formed driver portion 17 of the gear 3. However, this end of tool spindle portion 4' is always pushed away from the gear 4 by means of a compression spring 20 disposed between a spring plate 18 and a ball bearing 19.

The mode of operation of the automatic shutoff 21 in the described arrangement, which is also discussed extensively in the German Pat. No. 2,148,739, is as follows:

Upon the application of the tool (not shown) to the screw to be tightened or loosened, the tool spindle 4 is pushed toward the motor 2 and, because the valve rod 15 is blocked against axial movement by the ball 14 opposite the tool spindle 4, the valve 16 is opened and the motor 2 begins to run. If, after the screw is tightened, a torque level determined by the initial tension of the spring 10 is attained, then the balls 7 rise out of their recesses 6 and displace the plate 11 and the ring 13. The balls 14 are thus released and therefore the valve rod 15 as well as a result of which the valve 16 is closed. Thus, the motor comes to a stop. If the screw to be tightened or loosened has not yet been tightened or loosened sufficiently, then a further displacement of the tool spindle 4 against the force of the compression spring 20 can take place as a result of further axial pressure exerted on the compressed-air screwdriver.

Thus, the end of the valve rod 15 on the tool spindle side comes to a rest with its front face against a contact surface 22 of the bore 23 which houses the valve rod 15, and a further axial diaplacement reopens the valve 16, so that the driving motor 2 can start up again. By means of this further rotation, there occurs a further indexing of the shifting coupling 5 in sudden bursts. This further indexing in sudden bursts causes a further rotation of the screw with increased torque. This increase in torque is dependent on the construction of the shifting coupling 5 and amounts, for example, to approximately 20%.

When the screwdriver is lifted from the screw, the tool spindle is displaced back by the compression spring 20, so that the valve 16 closes again. Also, the freedom of motion of the valve rod 15 for initiating a new switching procedure is limited by the reverse movement of the ball 14 and the valve rod 15 is brought back into its initial position.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A compressed-air tool including a housing, a compressed air source, a tool spindle displaceably mounted in the housing, a spring connected to displace the tool spindle in a first direction, a motor connected to be driven by the compressed air source and to drive the tool spindle, an automatic shutoff having a valve which controls the connection of the motor to the compressed air source wherein the automatic shutoff is actuated by a torque responsive means to automatically turn off the motor when a predetermined torque is attained, further including:

an actuation means connected to the automatic shutoff to override the automatic shutoff and to turn the motor on after automatic turn off of the motor, wherein the actuation means upon inward axial displacement thereof overrides the automatic shutoff such that the tool spindle is displaced in a second direction to reopen the valve such that the compressed air tool is connected to the compressed air source to operate at a second torque which is greater than the predetermined torque.

2. A compressed-air tool in accordance with claim 1, wherein said automatic shutoff includes a valve rod connected to the tool spindle and connected to operate said valve, a releasable actuation element which includes at least one ball connected to block the axial movement of said valve rod and for releasing the axial movement of said valve rod when said predetermined torque is attained, wherein the length of said valve rod and the displacement of said tool spindle are selected so that upon axial displacement of the tool spindle said valve can be opened by said valve rod.

3. A compressed-air tool in accordance with claim 2, wherein said tool spindle is provided with a contact surface which engages and displaces said valve rod.

4. A compressed-air tool in accordance with claim 3, wherein said tool spindle includes an axial bore which engages the valve rod for guiding the axial movement of said valve rod and wherein said contact surface is formed by the bottom of said axial bore.

5. A compressed-air tool in accordance with claim 1, including a gear having a driver portion connected to said tool spindle and said motor for driving said tool spindle, said tool spindle having an end portion on a motor side arranged in contact with a means of the driver portion such that the tool spindle is axially displaceable within and is drivable by said means of the driver portion.

6. A compressed-air tool in accordance with claim 5, including a compression spring positioned between said tool spindle and said gear driver portion.

7. A compressed-air tool in accordance with claim 6, including a ball bearing and a spring plate in said housing and wherein said compression spring is disposed between said ball bearing and said spring plate.

* * * * *